US006617970B2

(12) United States Patent
Makiyama et al.

(10) Patent No.: US 6,617,970 B2
(45) Date of Patent: Sep. 9, 2003

(54) INGRESS-EGRESS MONITORING SYSTEM

(75) Inventors: Soichiro Makiyama, Kobe (JP); Hiroshi Yoshida, Sanda (JP)

(73) Assignees: Sanyo Electric Co., LTD, Moriguchi (JP); Sanyo Tuner Industries Co., Ltd., Daito (JP)

( * ) Notice: Subject to any disclaimer, the term of this patent is extended or adjusted under 35 U.S.C. 154(b) by 0 days.

(21) Appl. No.: 09/989,189

(22) Filed: Nov. 21, 2001

(65) Prior Publication Data

US 2002/0063627 A1 May 30, 2002

(30) Foreign Application Priority Data

Nov. 28, 2000 (JP) ..... 2000-361680

(51) Int. Cl.[7] ..... G08B 23/00

(52) U.S. Cl. ..... 340/573.1; 340/573.4; 340/5.2; 340/5.8; 340/5.81

(58) Field of Search ..... 340/573.1, 573.4, 340/572.1, 825.36, 10.1, 539.1, 539.11, 541, 5.1, 5.2, 5.23, 5.7, 5.8, 5.81

(56) References Cited

U.S. PATENT DOCUMENTS 5,317,309 A * 5/1994 Vercellotti et al. ..... 340/10.1
5,471,404 A * 11/1995 Mazer ..... 340/825.49
5,917,425 A * 6/1999 Crimmins et al. ..... 340/825.49
6,084,513 A * 7/2000 Stoffer ..... 340/572.2
6,225,906 B1 * 5/2001 Shore ..... 340/573.4
6,396,413 B2 * 5/2002 Hines et al. ..... 340/825.49

* cited by examiner

*Primary Examiner*—Toan N Pham
(74) *Attorney, Agent, or Firm*—Armstrong, Westerman & Hattori, LLP.

(57) ABSTRACT

The present invention provides an ingress-egress monitoring system comprising transmitting antennas 1 disposed respectively at a plurality of ingress-egress gates, tags 2 to be attached to respective persons to be checked for egress and each adapted to transmit an identification signal in response to radio waves received from the antenna 1, receivers 3 disposed respectively at the ingress-egress gates for receiving the identification signal from the tag and each operable to output a monitoring signal containing an ID code contained in the identification signal and the number of the gate of its own, and a monitor 5 connected to the receivers 3 for displaying the ID code and the gate number based on the monitoring signal output from the receiver 3. The tags 2 transmit the respective identification signals in cycles different one another.

3 Claims, 10 Drawing Sheets

INGRESS-EGRESS MONITORING SYSTEM

FIELD OF THE INVENTION

The present invention relates to ingress-egress monitoring systems for use in preventing persons, such as wanderers, whose behavior needs to be watched from egressing from an institution of protection or other specified area or from entering a dangerous area or like specified area.

BACKGROUND OF THE INVENTION

At hospitals and like institutions, it has been practice to restrain the behavior of mentally handicapped patients as by confining those with a serious illness in rooms in order to prevent the patients from going out of the institution without permission. It is desired in recent years to develop ingress-egress monitoring systems which are adapted to keep watch against wandering patients without restraining patients more than is necessary.

However, such a ingress-egress monitoring system must watch over a large number of patients to monitor their egress from gates provided at a plurality of locations, while when some patients passed through one gate at the same time, these persons need to be identified individually, so that the system has the problem of becoming complex in construction.

SUMMARY OF THE INVENTION

Accordingly, an object of the present invention is to provide an ingress-egress monitoring system of simple construction which is adapted to watch over many people to monitor their ingress into a specified area or their egress from the specified area and which is further capable of identifying a plurality of persons individually when these persons passed through the same gate at the same time.

The present invention provides an ingress-egress monitoring system which is characterized in that the system comprises:

- transmitters disposed respectively at a plurality of ingress-egress gates of a specified area for emitting radio waves to the respective gates,
- tags to be attached to respective persons to be checked for ingress or egress and each adapted to transmit an identification signal containing an ID code of its own in response to radio waves received from the transmitter,
- receivers disposed respectively at the ingress-egress gates for receiving the identification signal from the tag and each operable to output a monitoring signal containing the ID code contained in the identification signal and the number of the gate of its own, and
- a monitor connected to the receivers for detecting an incidence of ingress into or egress from the specified area based on the monitoring signal output from the receiver,
- the tags to be attached to the respective persons being operable to transmit the respective identification signals in cycles different from one another.

With the ingress-egress monitoring system of the present invention, tags are attached to all wanderers. The monitor is installed, for example, in a janitor's room. If a wanderer has passed through one of the ingress-egress gates, radio waves emitted from the transmitter provided at the gate are received by the tag on the wanderer, whereupon the tag prepares an identification signal containing the ID code of its own and transmits the signal toward the receiver.

In response to the identification signal, the receiver prepares a monitoring signal containing the ID code contained in the identification signal and the gate number of its own and feeds the monitoring signal to the monitor. Based on the monitoring signal output from the receiver, the monitor detects the ingress into or egress from the specified area and outputs the ID code and the gate number contained in the monitoring signal. The janitor can therefore identify the wanderer with reference to the ID code and also identify the gate through which the wanderer has passed with reference to the gate number.

For example, upon two wanderers passing through the same gate at the same time, two tags transmit their identification signals at the same time, but the receiver is unable to normally receive the identification signals due to interference. However, since these signals are transmitted in different cycles, the identification signals in the subsequent cycle are produced at different times, and the signals transmitted from the two tags can be received normally. Consequently, the persons passing through the same gate can be individually identified on the monitor.

Stated more specifically, the tags are set for different identification signal transmission cycles in advance. Further in transmitting the identification signal, each of the tags produces a random number and is set for the transmission cycle based on the random number. The cycle for which each of the tags is set is so adjusted that the receiver at the gate passed through is capable of receiving the identification signal a plurality of times from the same tag.

Accordingly, even if the receiver fails to receive identification signals produced at the same time in a certain cycle from tags passing through the same ingress-egress gate, the subsequent cycles comes around for the tags to produce identification signals again before the identification signal reception level lowers with the passage of the tags, so that the receiver is capable of receiving these identification signals at a sufficient reception level.

Thus, the ingress-egress monitoring system of the invention is usable for many persons to monitor their ingress into or egress from a specified area. Even if more than one person passed through one gate, the persons passing through the gate can be identified individually.

DETAILED DESCRIPTION OF EMBODIMENT

Figure 1:
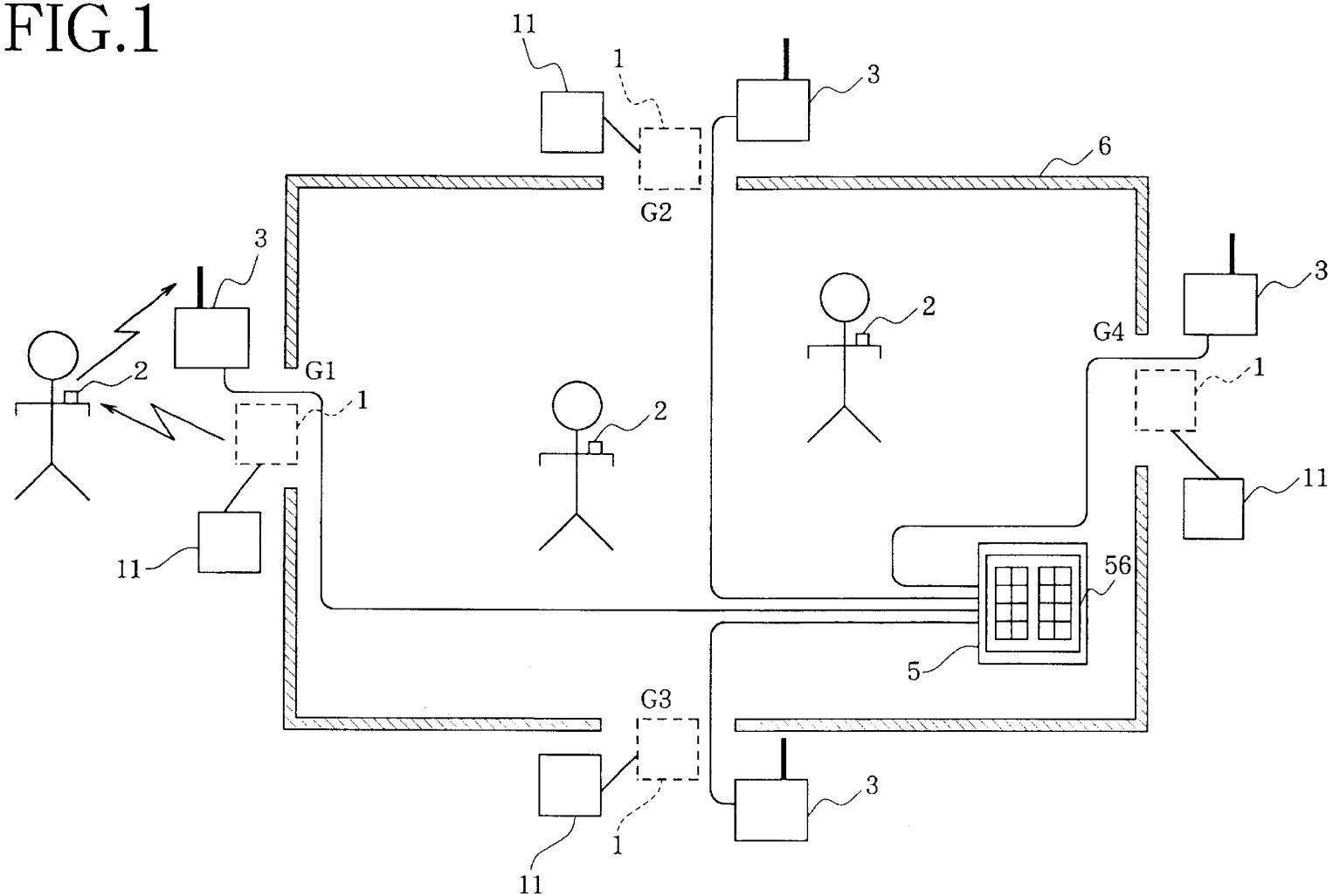
FIG. 1 is a diagram showing an arrangement of components providing an ingress-egress monitoring system of the invention.

An embodiment of ingress-egress monitoring system of the present invention will be described below with reference to the drawings. As shown in FIG. 1, the system embodying the invention is adapted to watch over patients (wanderers) accommodated in an institution 6 and having the likelihood of wandering, to monitor their egress from a plurality of gates G1 to G4 without permission. Tags 2 are attached to the respective wanderers. Each of the gates G1 to G4 is provided with a transmitting antenna 1, transmitter 11 connected to the antenna 1 and receiver 3. A monitor 5 provided with a data display 56 is disposed in a janitor's room and connected to the receivers 3 by signal cables.

When one wanderer is about to egress from the institution upon passing through one of the gates, radio waves emitted from the antenna 1 disposed at the gate are received by the tag 2 of the wanderer, whereupon the tag 2 prepares an identification signal containing an ID code of its own and transmits the signal to the nearest receiver 3.

The receiver 3 receives the identification signal from the tag 2, prepares a monitoring signal containing the ID code contained in the identification signal and the number of the gate of its own, and outputs the monitoring signal to the monitor 5. The monitor 5 detects the egress based on the monitoring signal output from the receiver 3, giving an alarm and displaying on the data display 56 the ID code and the gate number contained in the monitoring signal and the time when the egress took place.

Figure 2:
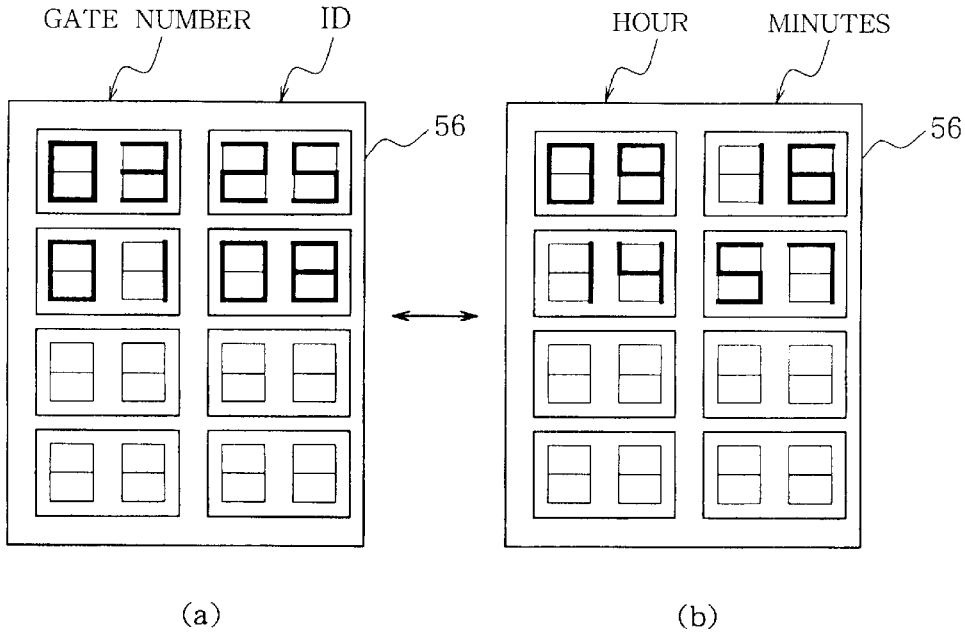
FIG. 2 is a diagram showing an example of data display on a monitor.

The data display 56 of the monitor 5 has four rows of display portions for presenting data as to four persons as shown in FIGS. 2, (*a*) and (*b*). Four-digit data can be displayed on each display portion. For example, it is possible to alternate between the operation of showing the gate number (0-3) with two digits among the four digits and showing the ID data (00-63) using the remaining two digits as shown in FIG. 2(*a*) and the operation of indicating the hour of day (hour, minutes) using the four digits as shown in FIG. 2(*b*). The transmitter 11 emits, for example, a signal of single frequency from the transmitting antenna 1 as radio waves to the vicinity of the gate.

Figure 3:
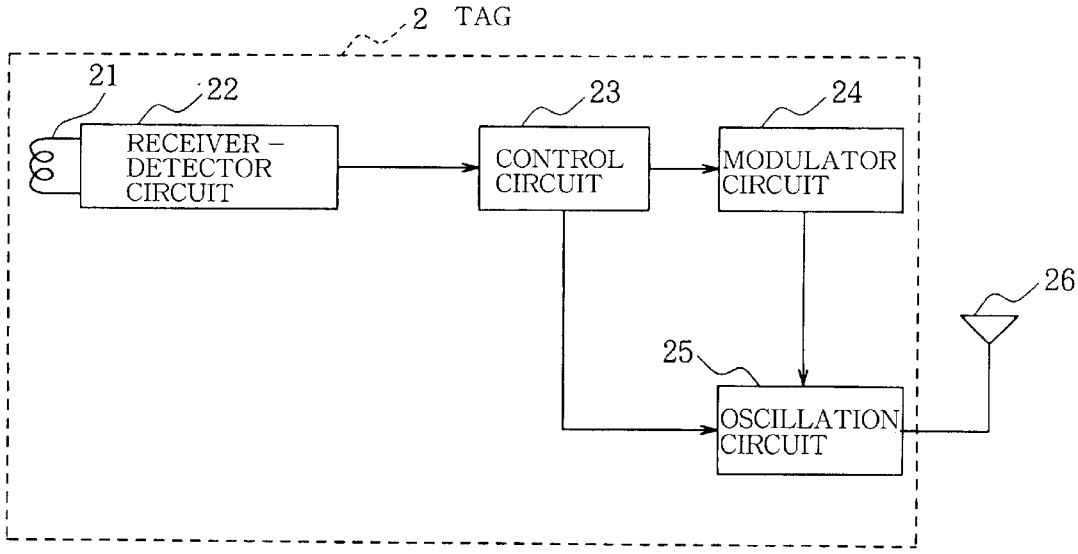
FIG. 3 is a block diagram showing the construction of a tag.

FIG. 3 shows the construction of the tag 2 specifically. A casing (not shown) which can be compactly attached to clothes has housed therein an antenna coil 21 for receiving radio waves from the transmitting antenna 1. A control circuit 23 is connected to the antenna coil 21 via a receiver-detector circuit 22. The passage of the wanderer wearing the tag 2 through the gate is detected by the control circuit 23.

The control circuit 23 has connected thereto a modulator circuit 24 and an oscillation circuit 25 and feeds the ID data given to the tag 2 to the modulator circuit 24 based on the result of detection. Consequently, an identification signal containing the ID data is transmitted from the oscillation circuit 25 via a transmitting antenna 26. The ID data comprises 8 bits, two of which represent the receiver number (0-3). The remaining 6 bits represent the tag number (0-63).

Figure 4:
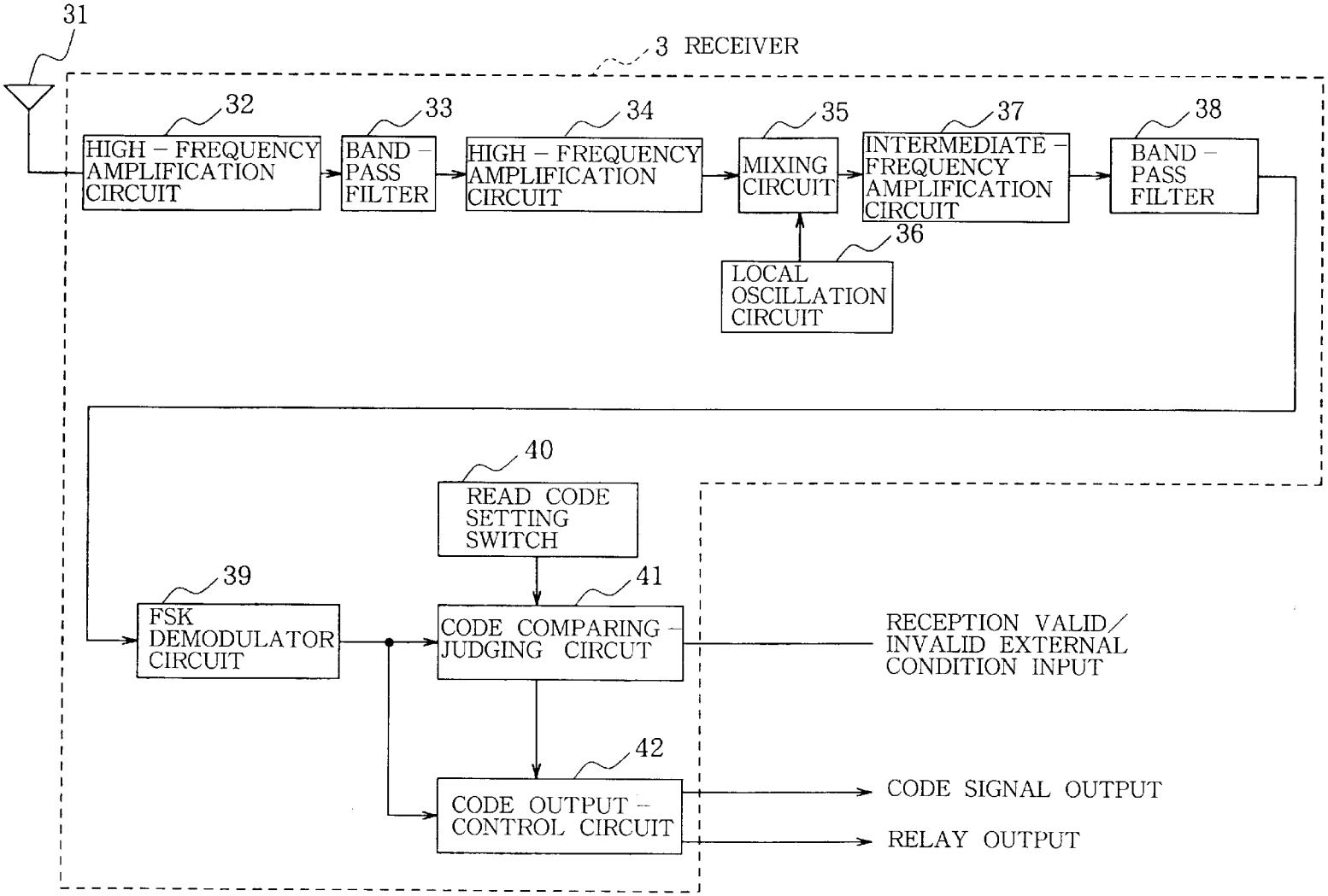
FIG. 4 is a block diagram showing the construction of a receiver.

With reference to FIG. 4, the receiver 3 has a receiving antenna 31 for receiving the identification signal transmitted from the tag 2. A mixing circuit 35 is connected to the antenna 31 via a high-frequency amplification circuit 32, band-pass filter 33 and high-frequency amplification circuit 34. A local oscillation circuit 36 is connected to the mixing circuit 35. An FSK demodulator circuit 39 is further connected to the output terminal of the mixing circuit 35 via an intermediate-frequency amplification circuit 37 and a band-pass filter 38. The FSK demodulator circuit 39 affords a demodulation signal, which is fed to a code comparing-judging circuit 41 and a code output-control circuit 42 which comprise CPU 1 and CPU 2. A read code setting switch 40 is connected to the code comparing-judging circuit 41.

Figure 7:
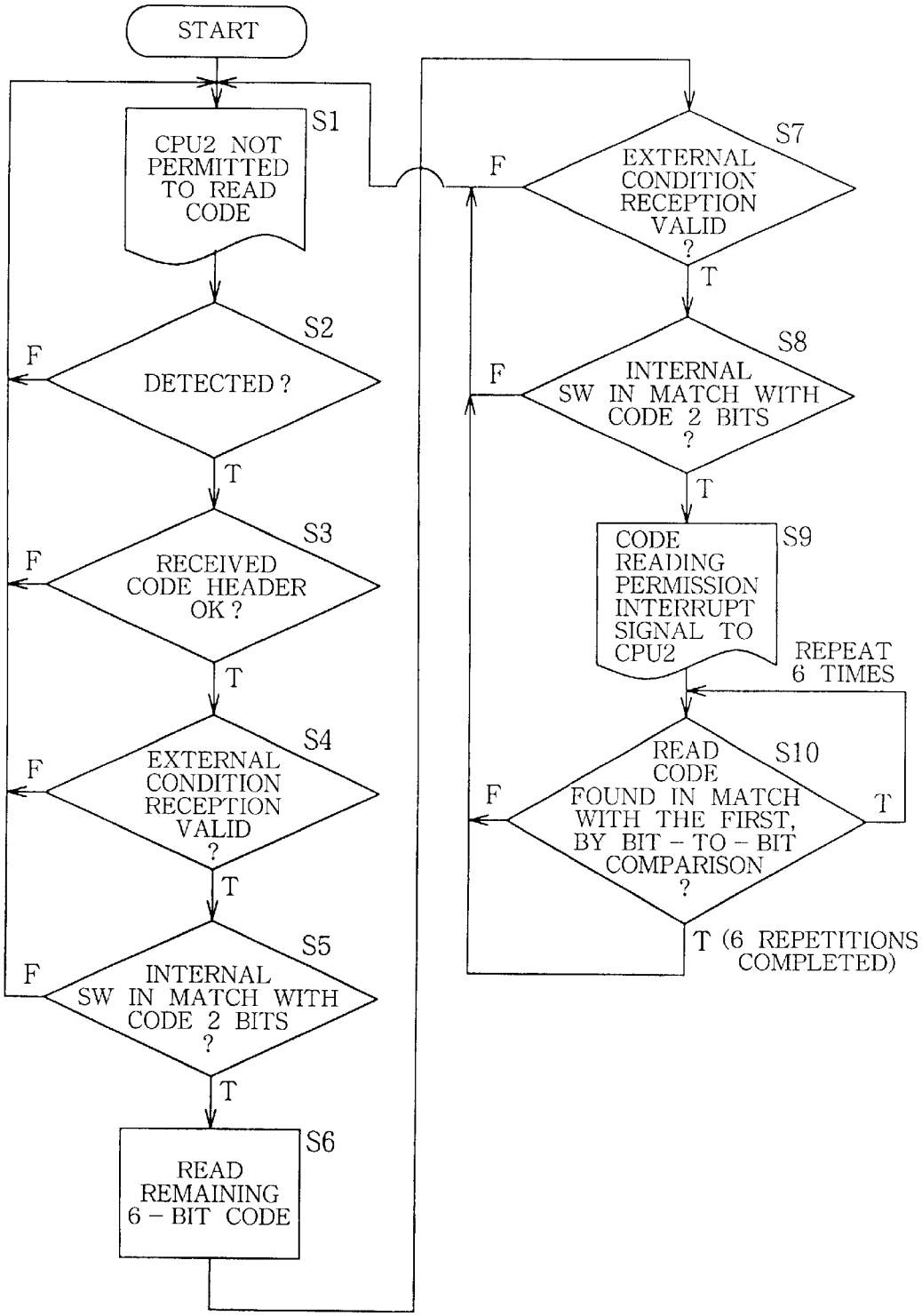
FIG. 7 is a flow chart showing a code comparing-judging procedure of the receiver.

FIG. 7 shows the code comparing-judging procedure to be performed by the code comparing-judging circuit 41. The circuit 41 judges whether reception is valid or invalid in accordance with a reception valid/invalid external condition input, also judges whether a read code set by the read code setting switch 40 is in match with the 2-bit code representing the receiver number, and further judges whether the received code is in conformity with the standard (steps S2 to S8). In accordance with the results of judging, the circuit 41 sends the code output-control circuit 42 a code reading permitting interrupt signal (step S9), and a signal not permitting code reading (step S1). The 8-bit data is taken in the first time in steps S5 and S6, and the 8-bit data is read the second time in steps S9 and S10. Step S10 provides a loop six times, and if the result is F (out of match), the repetition is discontinued without completion.

In response to the code reading permitting signal from the circuit 41, the code output-control circuit 42 reads the code thereinto. If the permission is withdrawn during code reading, the data is discarded. Prepared in the code output-control circuit 42 is a buffer wherein 64 4-bit-long data storages are provided with addresses of 0 to 63 given thereto respectively. For the reception of data, the code is set at the memory address of "0001," and the address is incremented in cycles of 1.3 sec if the content of the buffer is found to be other than "0001" with reference to the content (0 to 63 address). Accordingly when the state of "1111" is incremented, "0000" is obtained to bring the buffer to a cleared state.

Figure 8:
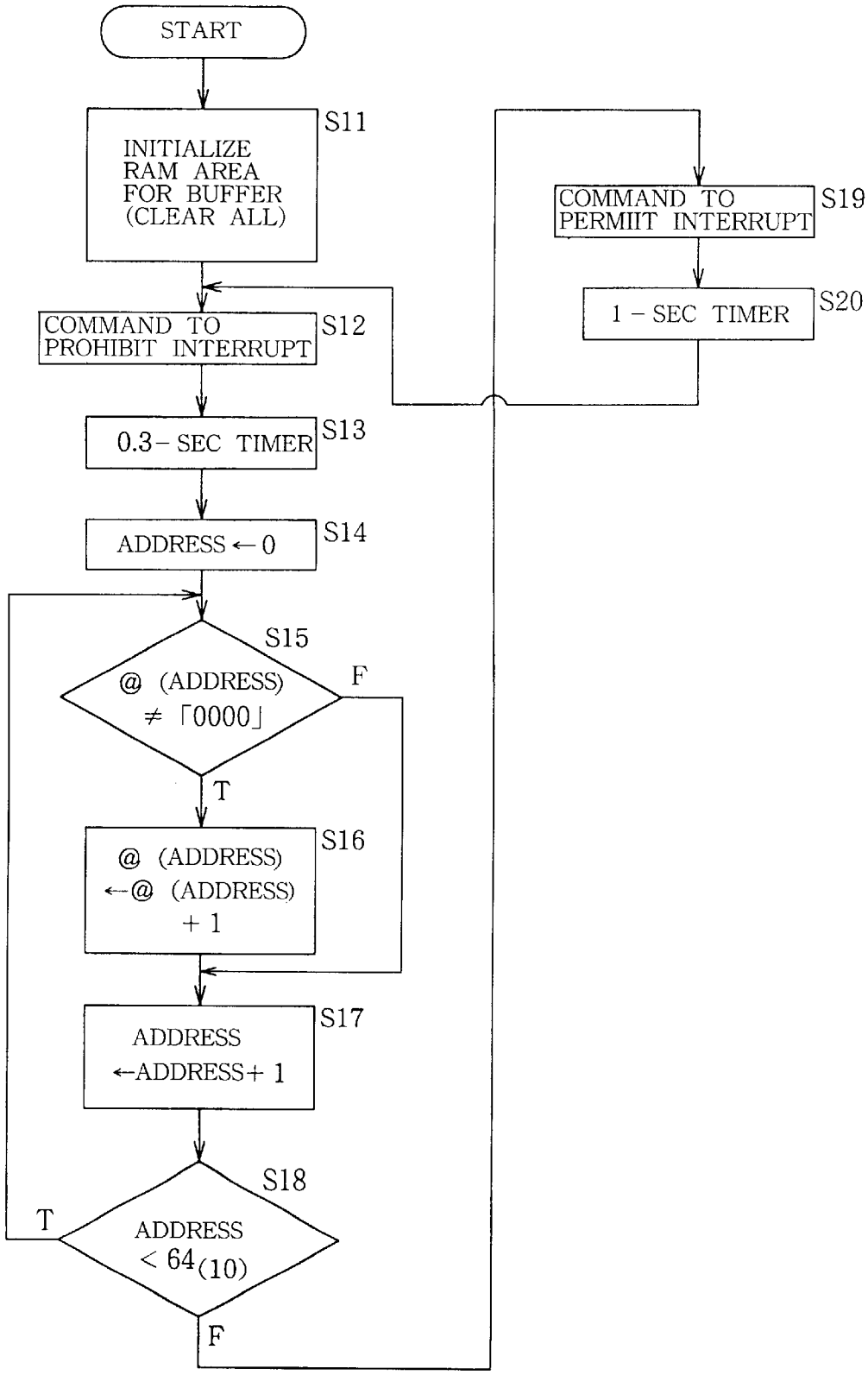
FIG. 8 is a flow chart showing a code output-control procedure of the receiver.
Figure 9:
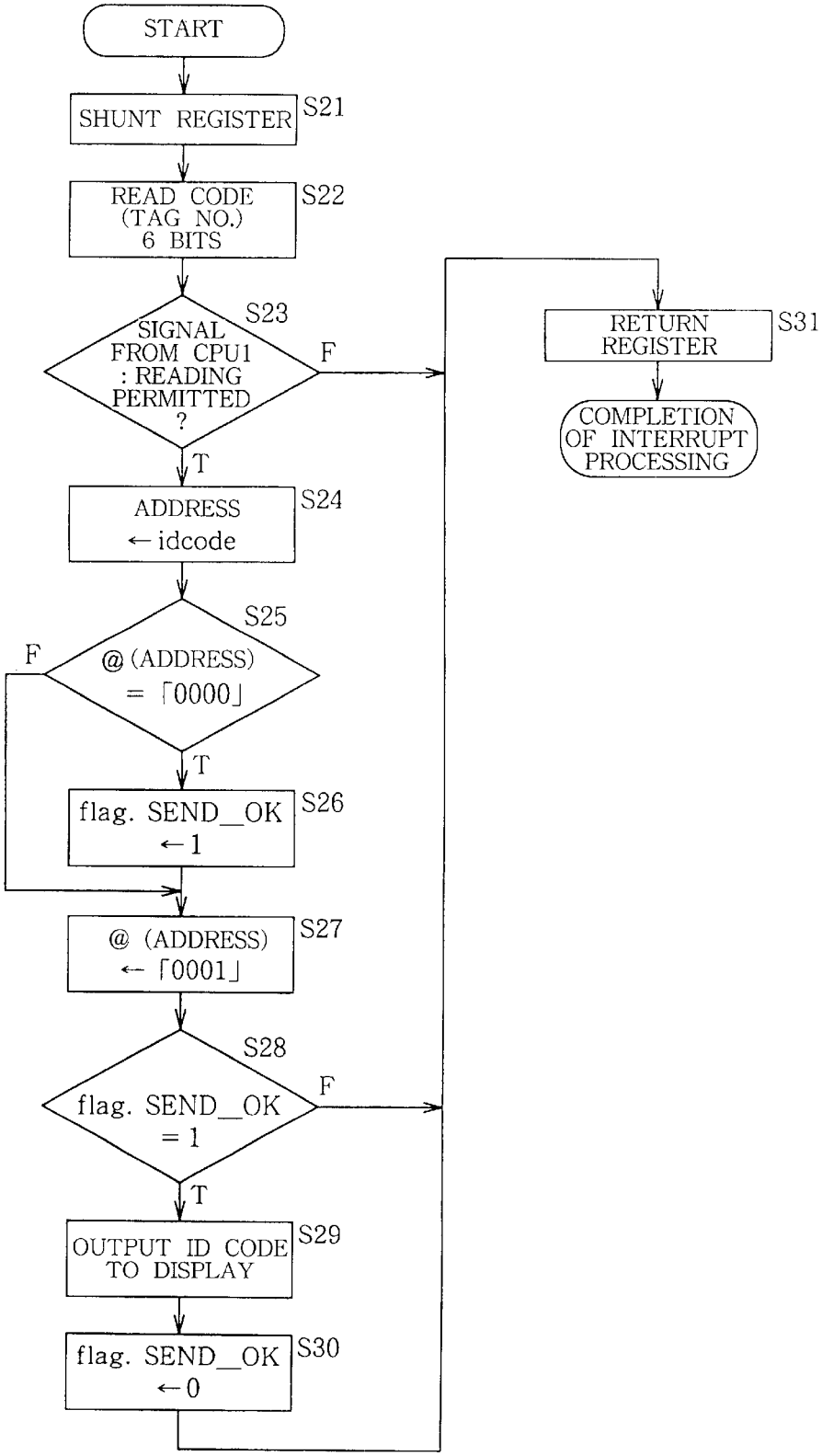
FIG. 9 is a flow chart showing an interrupt processing procedure of the receiver.

FIG. 8 shows the code output-control procedure to be performed by the code output-control circuit 42. When the circuit 42 reads thereinto a code not stored in the buffer, the data is sent to the monitor 5 by interrupt processing, and at the same time, counting is started in cycles of 1.3 sec. If the same code is not received after 15 cycles (about 20 sec), the buffer is cleared of the code, and when the same code is read in the next time, output to the monitor 5 is validated. Now, interrupt processing shown in FIG. 9 is effected with a 1-sec timer operation of FIG. 8, step S20.

As timed with the output of data to the monitor 5, the code output-control circuit 42 outputs a relay signal for energizing an external device control relay only for a specified period of time.

Figure 5:
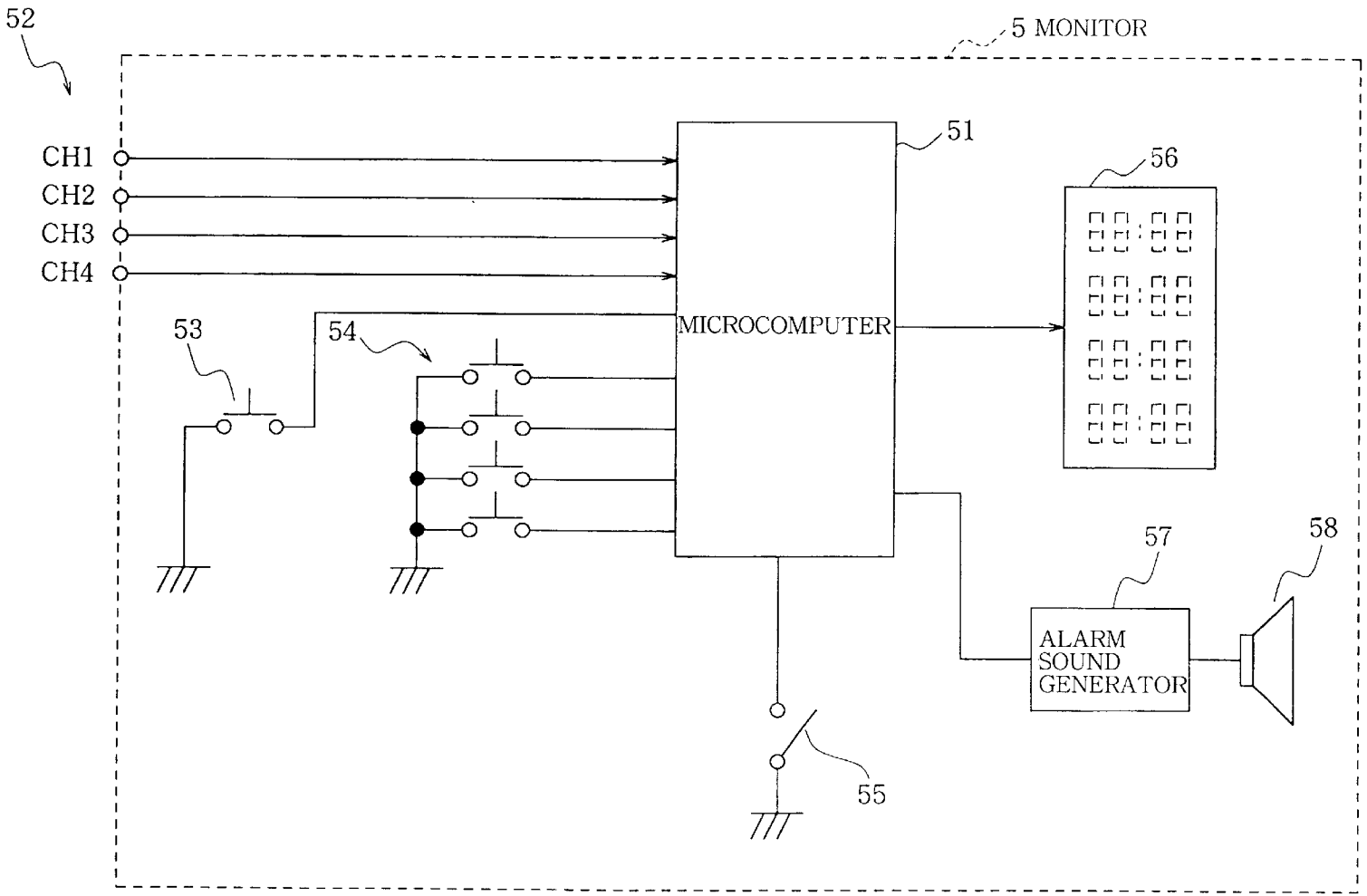
FIG. 5 is a block diagram showing the construction of the monitor.

As shown in FIG. 5, the monitor 5 has signal input terminals 52 of four channels for receiving the monitoring signal from the four receivers 3 arranged at the four gates. The signal input terminals 52 are connected to input ports of a microcomputer 51 for controlling the operation of the data display 56.

Further connected to input ports of the microcomputer 51 are a display change-over switch 53 for showing one of the presentations of FIGS. 2, (*a*) and (*b*) by a change-over, a line reset switch 54 for deleting (resetting) the display data on the desired channel, and an auto/manual reset change-over switch 55 for selecting automatic deletion of data or manual deletion of data. A speaker 58 is further connected to an output port of the microcomputer 51 via an alarm sound generator 57.

Figure 6:
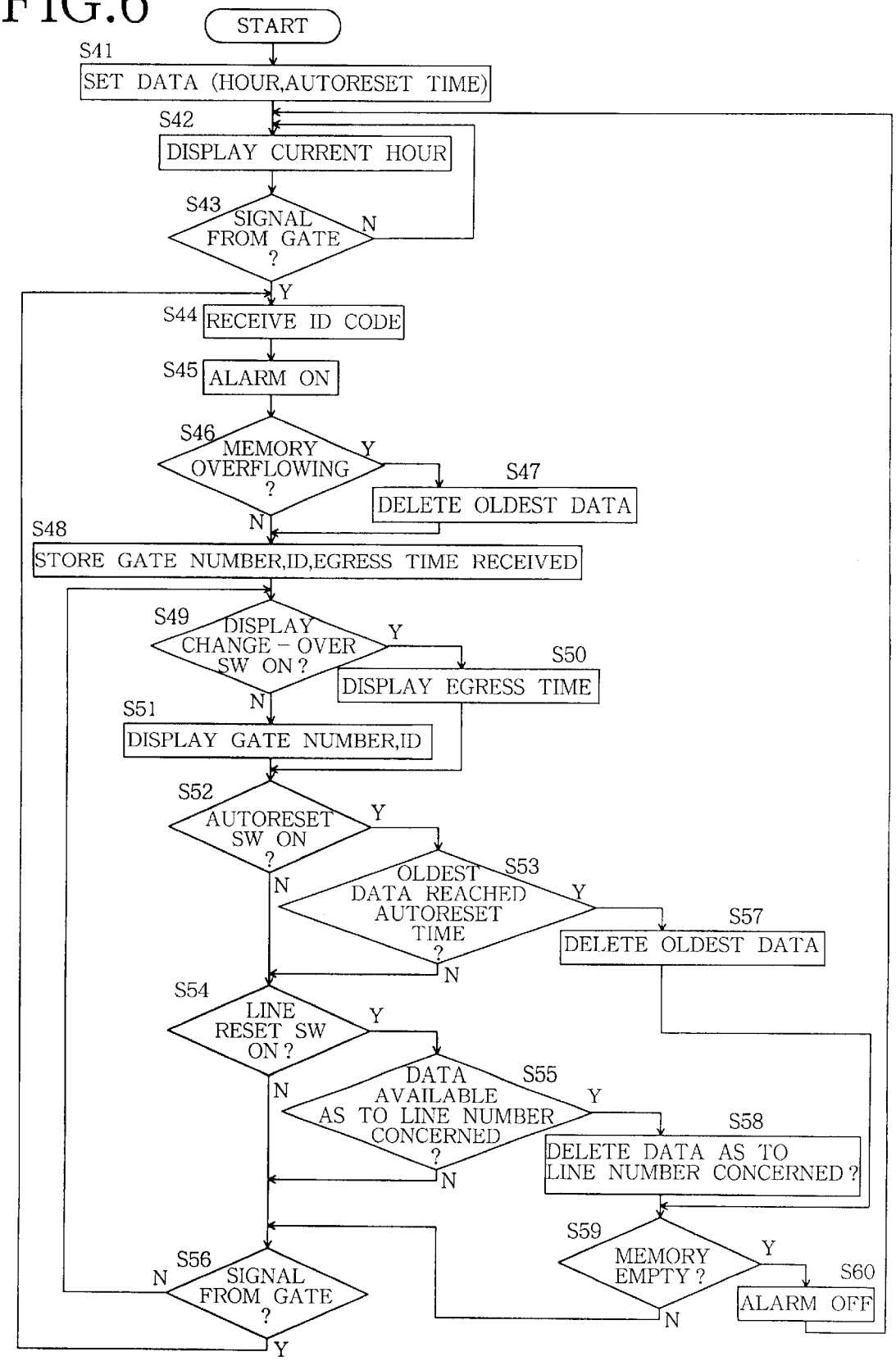
FIG. 6 is a flow chart showing the operation of the monitor.

FIG. 6 shows the control procedure to be executed by the microcomputer 51 of the monitor 5. First in step S41, various items of data, such as the hour, autoreset time, etc. are set to initial values, the current hour is shown on the data display 56 in step S42, and an inquiry is made in step S43 as to whether a signal is available from the gate. When the inquiry is answered in the affirmative, an ID code is received in step S44, and the alarm sound generator 57 is then operated in step S45 to produce an alarm sound.

Subsequently, an inquiry is made in step S46 as to whether the memory for storing data (ID codes, gate numbers, egress time, etc.) is overflowing. If the answer is affirmative, the oldest data is deleted in step S47, followed by step S48 in which the gate number, ID code and egress time received are additionally stored.

An inquiry is then made in step S49 as to whether the display change-over switch is on. If the answer is affirmative, egress time is shown on the display in step S50 (FIG. 2(*b*)), or if otherwise, the gate number and ID code are shown on the display in step S51. Step S52 thereafter inquires whether the autoreset switch is on. When the answer is affirmative, an inquiry is made in step S53 as to whether the oldest data has reached the autoreset time.

When the inquiry of step S53 is answered in the negative, an inquiry is made in step S54 as to whether one of the line reset switches is closed. When the answer is affirmative, step S55 inquires whether there is data as to the line number (channel) concerned. Step S56 follows if the answer is negative. If the inquiry of step S54 is answered in the negative, step S56 follows, with step S55 detoured.

If the answer to the inquiry of step S53 is affirmative, on the other hand, the oldest data is deleted in step S57, followed by step S59. When the inquiry of step S55 is answered in the affirmative, the data as to the line number (channel) concerned is deleted in step S58, and step S59 thereafter follows.

Step S59 inquires whether the memory becomes empty. When the answer is affirmative, the alarm is turned off in step S60, followed by step S42 again. If step S59 is answered in the negative, step S56 follows, which inquires whether a signal from the gate is available. If the answer is negative, the sequence returns to step S49 again, whereas if the answer is affirmative, step S44 follows again.

According to the procedure described above, the execution of step S47 prevents the memory from overflowing due to the production of new display data, and the old data is automatically deleted by performing steps S53 and S57. Further steps S55 and S58, when performed, delete the data as desired. The memory capacity can therefore be diminished. Moreover, the selective execution of step S50 or step S51 serves to compact the display 56.

Figure 10:
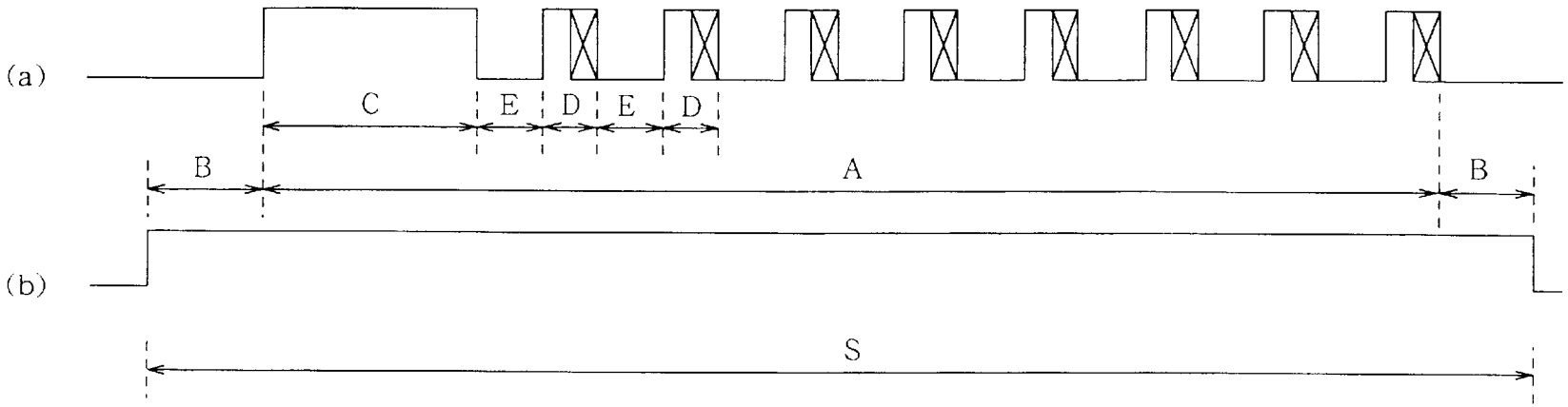
FIG. 10 is a flow chart for illustrating the structure of an identification signal.

FIG. 10, (*a*) shows the waveform of an ID code contained in the identification signal produced by the tag 2, and FIG. 10, (*b*) shows the timing of a carrier wave for carrying the ID code. As shown in FIG. 10, (*a*), the ID code comprises a header C of 2000 msec, and subsequent portions which are alternately repeated eight times, i.e., a 500-msec off period E and 500-msec data portion D containing 1-bit data. The carrier wave on which the ID code is to be superposed provides a signal over a 12-msec period S comprising a period A (10 msec) corresponding to the ID code, and a 1-msec period B joined to each of the front and rear of the period A.

Figure 11:
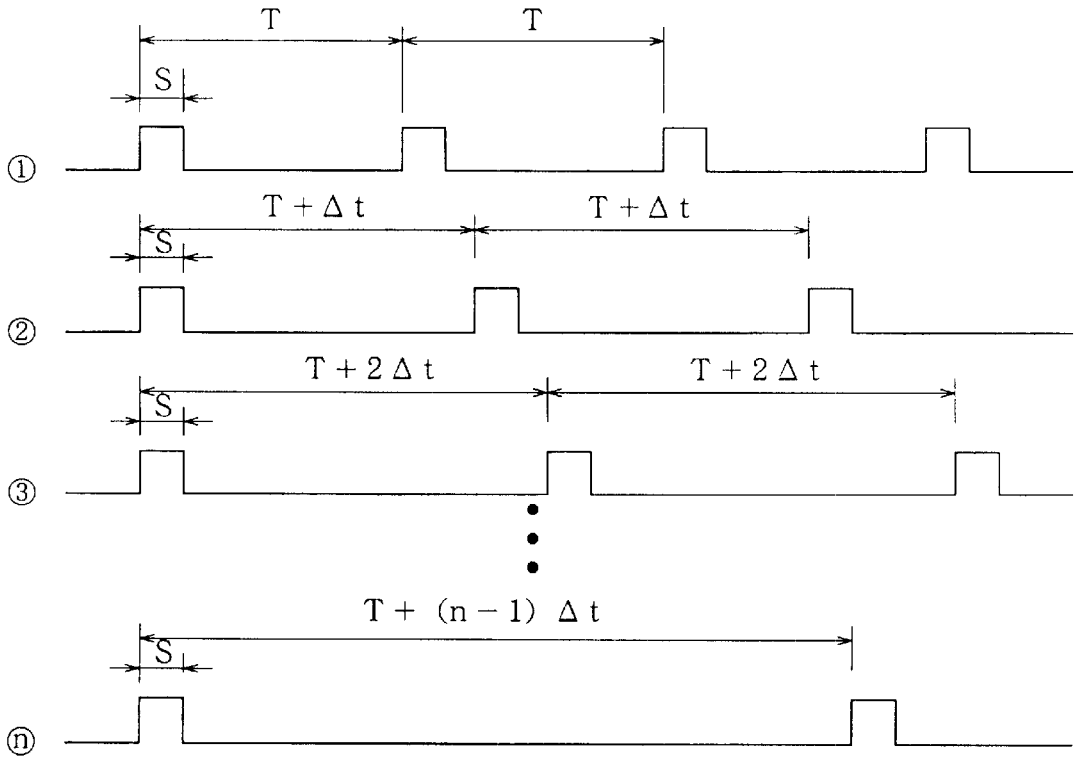
FIG. 11 is a time chart for illustrating differences between the periods of identification signals to be produced by a plurality of tags.

Identification signals each comprising the carrier wave and an ID code superposed thereon are transmitted from respective tags 2 in cycles which are different from one another as shown in FIG. 11. In the case where the wanderers to be monitored as described above are 64 in number, the signals are given 64 different periods which are assigned to the respective tags 2. For example when the period for the first tag is T, the period for the second tag is set at T+Dt, the period for the third tag at T+2Dt, and the period for the 64th tag at T+63Dt. Preferably, the difference Dt in period is longer than the period S of the identification signal.

Suppose different wanderers pass through the same gate at the same time. The tags of these persons then start to transmit respective identification signals at the same time. Even if the first identification signals are produced at the same timing as shown in FIG. 11, the next identification signals are produced with time differences Dt, so that the signals are unlikely to interfere or combine with one another.

The shortest period T is set at about 400 msec in view of the life of the cell (not shown) incorporated in the tag 2. Further the longest period T+63Dt is set at about 800 msec so that the identification signal can be transmitted at least twice during the period of passage of the wanderer through the gate.

In this case, the first to the 32nd tags 2 can be set for a period Ti (i=1–32) as given by Equation 1 below, and the 33rd to 64th tags 2 for a period Ti (i=33–64) as given by Equation 2 below. This makes it possible to produce two consecutive identification signals with a time difference of 12 msec therebetween, whereby the interference between the signals is avoidable.

$$Ti=(400+12'(i-1))(\text{msec}) \quad \text{(Equation 1)}$$

$$Ti=(400+12'(i-33))(\text{msec}) \quad \text{(Equation 2)}$$

Alternatively, the first to 64th tags can be set for a period Ti (i=1–64) as given by Equation 3 below, in which RANDOM (0–31) is a random number in the range of 0 to 31. In preparing the identification signal, each tag is caused to produce a random number to calculate the period Ti from Equation 3 given below.

$$Ti=(400+\text{RANDOM}(0-31))(\text{msec}) \quad \text{(Equation 3)}$$

This makes it possible to produce two consecutive identification signals with a time difference of 12 msec therebetween with a high probability, whereby the interference between the signals is avoidable. As a result, the wanderers passing through the same gate at the same time can be identified individually on the display of the monitor 5.

What is claimed is:

1. A system for monitoring ingress into or egress from a specified area, the ingress-egress monitoring system being characterized in that the system comprises:

transmitters disposed respectively at a plurality of ingress-egress gates of the specified area for emitting radio waves to the respective gates, tags to be attached to respective persons to be checked for ingress or egress and each adapted to transmit an identification signal containing an ID code of its own in response to radio waves received from the transmitter, receivers disposed respectively at the ingress-egress gates for receiving the identification signal from the tag and each operable to output a monitoring signal containing the ID code contained in the identification signal and the number of the gate of its own, and a monitor connected to the receivers for detecting an incidence of ingress into or egress from the specified area based on the monitoring signal output from the receiver, the tags to be attached to the respective persons being operable to transmit the respective identification signals in cycles different from one another, wherein the cycle for which each of the tags is set is so adjusted that the receiver at the gate passed through is capable of receiving the identification signal a plurality of times from the same tag.

2. An ingress-egress monitoring system according to claim 1 wherein the tags are set for different identification signal transmission cycles in advance.

3. An ingress-egress monitoring system according to claim 1 wherein in transmitting the identification signal, each of the tags produces a random number and is set for the transmission cycle based on the random number.

* * * * *